United States Patent [19]

Dubrovsky et al.

[11] Patent Number: 4,586,563

[45] Date of Patent: May 6, 1986

[54] TUBE-AND-PLATE HEAT EXCHANGER

[76] Inventors: Evgeny V. Dubrovsky, ulitsa Chaikovskogo, 18, kv. 203, Moscow; Leonid A. Averkiev, ulitsa Gagarina, 40-a, kv. 137, Orenburg; Natalya I. Martynova, ulitsa Komsomolskaya, 15, kv. 38, Ljubertsy Moskovskoi oblasti, all of U.S.S.R.

[21] Appl. No.: 233,590

[22] PCT Filed: Jun. 20, 1979

[86] PCT No.: PCT/SU79/00041

§ 371 Date: Feb. 3, 1981

§ 102(e) Date: Feb. 3, 1981

[87] PCT Pub. No.: WO80/02872

PCT Pub. Date: Dec. 24, 1980

[51] Int. Cl.[4] ..... F28D 1/04

[52] U.S. Cl. ..... 165/151; 165/182

[58] Field of Search ..... 165/157, 152, 153, 148, 165/149, 182, 150, 151, 10, 166, 167; 29/157.3 A, 157.3 C

[56] References Cited

U.S. PATENT DOCUMENTS

| | | | |
|---|---|---|---|
| 1,408,060 | 2/1922 | Andersen | 165/148 |
| 2,032,065 | 2/1936 | Mondine | 165/151 |
| 2,246,258 | 6/1941 | Lehman | 165/151 |
| 3,645,330 | 2/1972 | Albright | 165/151 |
| 3,702,632 | 11/1972 | Grimshaw | 165/152 |
| 3,983,935 | 10/1976 | Henrion | 165/166 |

FOREIGN PATENT DOCUMENTS

| | | | |
|---|---|---|---|
| 322399 | 6/1902 | France | 165/182 |
| 13965 | 5/1903 | Sweden | 165/182 |
| 360280 | 11/1931 | United Kingdom | 165/151 |
| 389,277 | 10/1973 | U.S.S.R. | 165/151 |
| 658,360 | 4/1979 | U.S.S.R. | 165/151 |

*Primary Examiner*—William R. Cline
*Assistant Examiner*—Peggy A. Neils
*Attorney, Agent, or Firm*—Fleit, Jacobson, Cohn & Price

[57] ABSTRACT

A tube-and-plate heat exchanger comprising a plurality of plain tubes intended for a first heat carrier to pass through, which tubes are arranged in parallel rows and are received in broached holes of spaced plates. In cross section the plates are profiled so as to form, in the direction of flow of another, for example, a gaseous heat carrier, a continous symmetrically waved line, thereby forming a passage of undulatory shape for the gaseous heat carrier to flow through. Projections and depressions of each plate face corresponding projections and depressions of the other adjacent plate, thereby forming passages with alternating diverging-converging sections. The projections and the depressions of the cooled plates are made contiguous by rectilinear sections which each have an angle ($\phi$) of inclination to the axis of symmetry of the cross-sectional wave line ranging from 8 to 45 deg. The inner radius of bending at the place of mating with the projections and the depressions is not more than twenty times the thickness of the material of the spaced plate. To ensure good thermal contact between the plain tubes and the cooled plates, the edges of the broached holes are sintered to the surface of each tube around its periphery.

1 Claim, 4 Drawing Figures

TUBE-AND-PLATE HEAT EXCHANGER

FIELD OF THE INVENTION

The present invention relates to heat engineering, and more particularly, to a tube-and-plate heat exchanger.

BACKGROUND OF THE INVENTION

There is known a tube-and-plate heat exchanger used in the constructions of water-to-air coolers installed in motor vehicles, tractors and diesel locomotives. This type of heat exchanger comprises a plurality of plain round tubes for the passage of a cooled working fluid. These tubes are received in respective through holes formed in flat cooled plates. The tubes for the passage of a working fluid can be arranged either in parallel rows or in staggered manner. Thus, the coolers of this type are constructed so as to permit plain rectangular passages or channels to be formed in the intertubular space thereof. These channels or passages are not provided with vortex generators required to intensify the heat exchanging process in the intertubular space. This intensification of the heat exchanging process is necessitated because of the limitation that water-to-air coolers of various power plants operate under conditions where the over-all heat transfer coefficient K of the cooler is approximately equal to the air heat emission coefficient $\alpha$, i.e. $K \approx \alpha_1$. Therefore, a reduction in size and weight of the water-to-air cooler calls for the increase in K, which is single-valued as $\alpha_1$. The value of $\alpha_1$ is known to be the smallest in plain passages. Therefore, the prior-art tube-and-plate heat exchanger is large in size and weight.

The tube-and-plate heat exchangers of the aforedescribed construction can be reduced in size and weight only by increasing the heat emission coefficient $\alpha_1$, which is possible by producing air flow turbulence in the cooler with the aid of various vortex generating means.

There is also known in the art a tube-and-plate heat exchanger (see a book by V.Z. Babichev "Manufacture of Automobile Radiators", published in 1958, Mashgiz Publishers, Moscow, p, 47) which comprises plain tubes for the passage of cooled water, the tubes being arranged either in parallel rows or in staggered fashion. In order to intensify the process of convective heat exchange in the intertubular space, the cooled plates are profiled, in the travelling direction of air flow, so as to form a continuous symmetrical waved line. The cooled plates are arranged on the cooler tube bundle so that projections and depressions of each pair of the adjacent plates are equidistant from one another. As a result, there are formed, in the interspace between the adjacent cooled plates, passages for cooling air, which have undulatory shape if viewed in the travelling direction of the air flow.

The known water-to-air coolers have been tested to show insufficiently high thermohydraulic effectiveness. The reason for this is that the increase in the heat emission coefficient $\alpha_1$ in such passages is lagging very much behind that of the energy input required for stepping up the process of heat transfer as compared with smooth passages. This is because vortices, formed by a flow of air behind and before each turn in such passages, are equal to, or commensurate with, the height of projection of the waving passage. It should be added that the height of the projection in these types of passages is equal to, or commensurate with, the hydraulic passage diameter. As a result, the amount of energy delivered to the cooled air in waving passages is lost (by 70 to 80%) to effect transition to turbulence in the core of the flow where the temperature field gradient and that of the heat flow density are small enough to bring about any substantial increase in the heat flow density. Since these large-scale vortices possess considerable kinetic energy, they, on overcoming the forces of viscosity and friction and thus gradually dissociating, are thereafter displaced to merge with the wall layer of air. This results in the wall layer becoming turbulent, with the turbulence heat conduction and the heat flow density increasing therein. Therefore, the heat exchange process in the waving passage is intensified by the turbulence of the wall layer of the air flow and not in its core, though the loss of additional energy fed to the air flow in the waving passage so as to induce turbulence in the core of the flow is much greater than that required to produce turbulence in the wall layer thereof. And this is the main reason for low thermohydraulic effectiveness of the heat exchanging surface of the prior-art tube-and-plate heat exchanger.

DISCLOSURE OF THE INVENTION

The present invention has as its aim the provision of a tube-and-plate heat exchanger with passages for a heat carrier arranged so as to permit thermohydraulic effectiveness to be enhanced by intensifying convective heat exchange in the passages with swirl vanes of a definite shape along the intertubular space, characterized by more rapid or equal growth of heat transfer with respect to the rise in hydraulic resistance, as compared to similar but smooth passages.

This aim of the invention is attained in a tube-and-plate heat exchanger comprising a plurality of tubes intended for a first heat carriers to pass through, the tubes being received in broached holes formed in a stack of cooled plates profiled in cross section so as to form, in the flow direction of another heat carrier, a continuous symmetrically waved line. According to the invention, the cooled plates are arranged so that projections and depressions of one plate face respective projections and depressions of another plate adjacent thereto, thereby forming passages with continuous symmetric diverging-converging sections, the diffuser flaring angle being selected to be more than the critical angle of the primary loss in hydrodynamic stability of laminar structure of the heat carrier flow.

Projections and depressions of the cooled plates are preferably mated with rectilinear sections having the same angle of inclination to the axis of symmetry of the wave line outlining the cross section of the cooled plate, which angle equals half the angle of the diffuser.

It has been found preferable for the angle of inclination of the rectilinear section to be set at an angle of 8 to 45 deg. relative to the axis of symmetry of the wave line outlining the cross-sectional profile of the cooled plate.

To ensure uniform distribution of a heat carrier over the passages formed in the intertubular space of a heat exchanger, it is necessary that the diverging-converging sections of the passages should have, at the point of the heat carrier entrance to and its exit from the stack of cooled plates, rectilinear sections lying in the plane of symmetry of the wave line outlining the cross-sectional profile of the cooled plates.

The bending radius of the projections and depressions of each cooled plate should not be more than twenty times the thickness of the cooled plate material.

It is expedient that the orientation of the edges of the broached holes, formed in the cooled plates to receive the tubes, should be oriented in the oppositely reflected fashion relative to the respective projections and depressions of the cooled plates.

The edges of the broached holes are preferably formed throughout their surfaces, around the periphery of each tube.

The use of the heat exchanger construction of the invention, for example, as the tractor water-to-air cooler, permits, all other conditions being equal, the size and weight thereof to be reduced 1.5 to 2 times, as compared with the known heat exchangers of similar type, to say nothing of its higher resistance to contamination, wherein air-suspended particles of dust and dirt are prevented from penetrating into the air space thereof.

BRIEF DESCRIPTION OF THE DRAWINGS

The invention will now be explained, by way of example only, with reference to the accompanying drawings, wherein.

BEST MODE OF CARRYING OUT THE INVENTION

Figure 1:
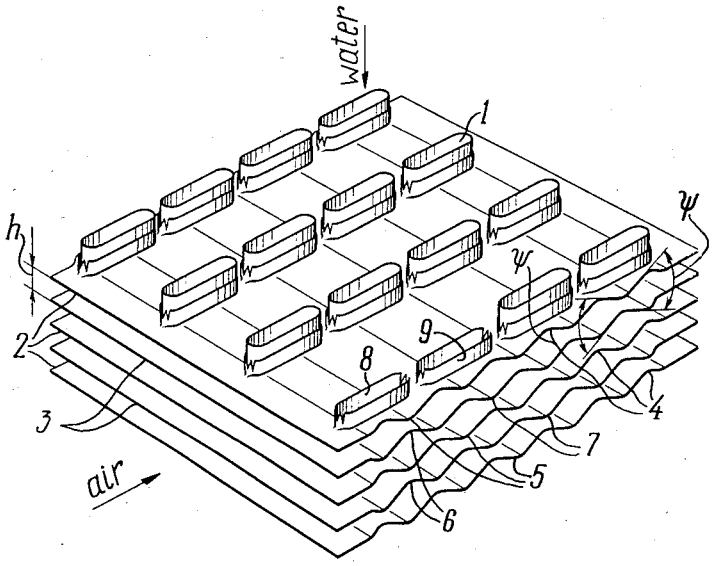
FIG. 1 is a general view of a tube-and-plate heat exchanger of the invention.

Referring now to the above drawings, and to FIG. 1 in particular, there is shown a cross-flow tube-and-plate heat exchanger which comprises a plurality of plain tubes 1 arranged, in the preferred embodiment, in parallel rows and intended for the passage of one heat carrier. Mounted on the tubes 1 and spaced from one another at an interval h are upper adjacent plates 2 and lower adjacent plates 3, which are cooled with air. In cross section the air-cooled plates 2 and 3 are profiled so as to form, in the air flow direction, a continuous waved line. The adjacent upper and lower air-cooled plates 2 and 3 are arranged in the heat exchanger so that projections 4 and depressions 5 of each upper adjacent plate 2 face respective projections 6 and depressions 7 of each lower adjacent plate 3. Thus, the intertubular space of the heat exchanger is formed with passages having continuously alternating diverging-converging sections with the same diffuser diverging and converging angle $\psi$.

Figure 2:
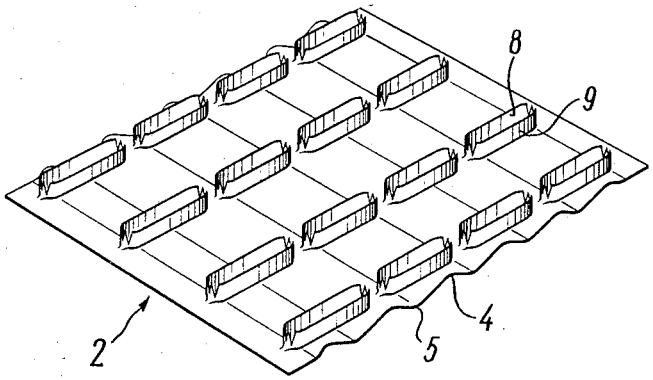
FIG. 2 is a view of one of the adjacent plates of a heat exchanger, according to the invention.
Figure 3:
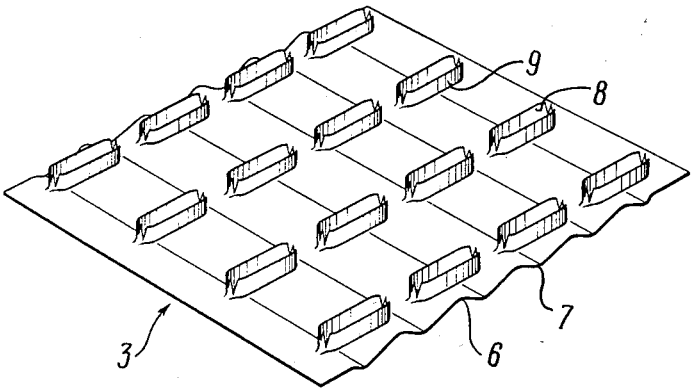
FIG. 3 is a view of another type of the adjacent plates of a heat exchanger, according to the invention.

For reliable connection of the plain tubes 1 with the air-cooled plates 2 and 3, the latter are broached to have holes 8 with upstanding edges 9. In the upper plate 2 (FIG. 2) and the lower plate 3 (FIG. 3) adjacent therewith, the edges 9 of the broached holes 8 are oriented in oppositely reflected fashion in relation to the respective projections 4 (FIG. 2) and 6 (FIG. 3) and the depressions 5 (FIG. 2) and 7 (FIG. 3).

The projections 4 (FIG. 4) and the depressions 5 of the cooled plates 2 mate with one another along rectilinear sections 10 which each have the same angle $\phi$ of inclination to the axis of symmetry of the wave line outlining the profile of the cooled plate 2. The projections 5 (FIG. 1) and the depressions 7 of the plates 3 mate with one another in a similar manner. As a result, the intertubular space of the heat exchanger is formed with passages having continuous symmetric diverging-converging sections wherein the angle $\psi$ of divergence is equal to the angle of convergence.

The wave line outlining the profile of the cooled plates 2, 3 (FIG. 4) is confined, from the side of the cooling air entry to and exit therefrom, by rectilinear sections 12 lying on the axis 11 of its symmetry. Thus, in the cooling air flow direction indicated by an arrow, the cooled plates 2, 3 (FIG. 1) are confined by plane-parallel sections.

Figure 4:
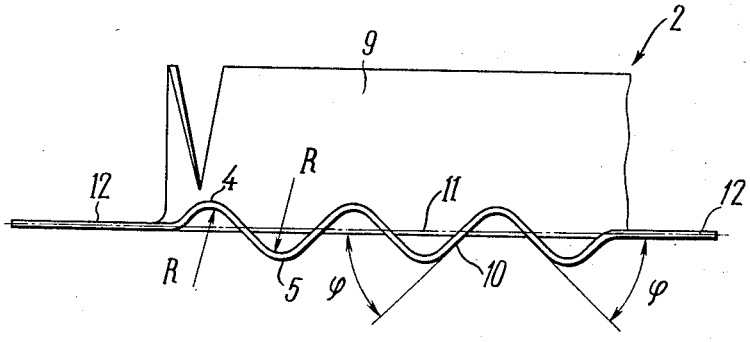
FIG. 4 is a cross section of one of the plates of a heat exchanger, according to the invention.

The projections 4, 6 and the depressions 5, 7 are made round over the bending radius R (FIG. 4).

Intensification of the convective heat exchange process in the heat exchanger of the invention is conditioned by the following factors.

As the cooling air flows through the intertubular space of the heat exchanger, the convective heat exchange process is stepped up in the passage due to the fact that the loss of hydrodynamic stability of the heat carrier flow laminar structure takes place primarily on the diffuser walls in the diverging sections of the air passages. The diffuser flare angle $\psi$ (FIG. 1), at which the primary loss of hydraulic stability takes place in the flow laminar structure, is called the critical angle. A minimum value of this critical angle, enabling favourable hydrodynamic conditions for the flow of air in the annular diffuser, has been found to be 8 deg. With the diffuser flaring angle $\psi$ ranging from 16 to 90 deg. in excess of the critical angle, the loss of hydrodynamic stability of the air flow laminar structure in the diverging sections of the passages formed in the intertubular space is a continuous process. As a result, vortices are generated on the diffuser walls in the wall layer of the heat carrier at a corresponding flaring angle $\psi$ of the diffuser and under requisite flow conditions. This, in turn, results in a sharp increase of eddy viscosity and heat conduction of this layer, as well as in the temperature gradient and heat flow density. Hence a substantial increase (up to 2.5 times) in the coefficient $\alpha_1$ of heat transfer from the cooling air to the walls of the diverging-converging passages occurs. It is to be noted that no additional energy is required for the core of the air flow. This can be explained by the fact that the projections 4, 6 and the depressions 5, 7 of the continuously alternating diverging-converging sections mate with one another over the radius R (FIG. 4). A selection of R within the range of $R=/1-20/\sigma$ (not more than 20 times), where $\sigma$ is the thickness of the material of the cooled plate 2, 3 (FIG. 1), results in a three-dimensional vortex, disposed in the wall layer of the heat carrier, being generated along the walls of the diverging-converging sections of the passages. Here the hydrodynamic structure in the core of the flow remains the same as in a smooth passage throughout the entire operating range of the heat carrier flow.

Therefore, in the heat exchanger of the invention the additional energy, required for the intensification of the heat exchange process is consumed primarily for the generation of the wall three-dimensional vortex which accounts for a sharp increase in the tubular viscosity and heat conduction of the wall layer of the flow, as compared with the same parameters obtained in a smooth passage. This factor allows a substantial increase in the heat transfer rate to be obtained with relatively low energy input required for the delivery of the heat carrier in the diverging-converging types of passages. With regard to diverging-converging types of passages, a maximum increase in the heat transfer coefficient $\alpha_1$, being $\alpha/\alpha^1=2.2-2.5$ with an increase in the loss of pressure of the heat carrier being $(\Delta P)/(\Delta P^1)=2.2-2.5$, where $\alpha,\alpha^1$ are respectively heat transfer coefficients in the diverging-converging and smooth passages; $\Delta P$, $\Delta P^1$ are respectively the pressure losses in the heat carrier in the diverging-converging and smooth passages. Thus it has become possible to effect substantial reduction (up to 2–2.5 times) in size, weight and cost of conventional water-to-air coolers currently used in tractors, automobiles and diesel locomotives, by introducing diverging-converging types of passages instead of smooth type of passages used in the prior-art heat exchanger.

The heat exchanger according to the invention is well adapted to operate on contaminated air wherein the generation of vortices on the walls of the passages prevents the air-suspended particles of dust and dirt from being deposited thereon due to the action of centrifugal forces in the wall area which is, effective to carry out these particles through the intermediary layer into the core of the flow to be thereafter discharged from the cooler together with the main air flow.

With a purpose of creating favourable conditions for intensifying the convective heat exchange process in the diverging-converging passages formed by the adjacent cooled plates 2 and 3, the projections 4, 6 and the depressions 5, 7 of these plates mate with one another through the rectilinear sections 10 (FIG. 4) having the same angle $\phi$ of inclination to the axis 11 of symmetry of the wave line outlining the passage profile. As a result, the air heat exchange surface is defined by the symmetric diverging-converging section of the passages. The equality of angles $\phi$ is required since one side of the cooled plate 2, 3 (FIG. 1) is, for example, the diverging section of the air passage, while the other side is the converging section of the passage and vice versa. The absence of symmetry of the angles $\phi$ (FIG. 4) of inclination in conjugating rectilinear sections 10 may result in a relatively large length of the diverging sections of the passages at one side of the cooled plate 2, 3 (FIG. 1), which makes it possible to dampen the vortices in the wall layer of the air flow. Simultaneously, the length of the diverging section of the passage will be reduced at the other side of the cooled plate 2, 3 along which three-dimensional vortices are generated with the ensuing intensification of the convective heat exchange process.

Depending on the operating range of the heat carrier flow, the angle $\phi$ (FIG. 4) of inclination of the conjugating rectilinear sections 10 is altered within the range of $\phi=8$ to 45 deg., which corresponds to the range of change in the diffuser flare angle $\psi$ (FIG. 1)$=2\cdot\phi$ (FIG. 4)$=16$ to 90 deg.

The change of angle $\phi$ within the above range makes it possible for the heat transfer coefficient $\alpha_1$ to grow faster or at the same rate with the loss of pressure, as compared with the smooth heat-exchange surface. However, a decrease in the angle $\phi$ below 8 deg. fails to bring about any significant intensification of the convective heat exchange process, which makes it impractical to develop tube-and-plate heat exchangers of smaller size and weight, and at reduced expences. If the angle $\phi$ of inclination is less than 8 deg., the converging section of the air passage will be substantially increased in length, which, in turn, will result in its enhanced stabilizing effect on the turbulent structure of the flow in the passage. An increased length of the converging section of the passage will result in the damping of vortices at the very beginning of the converging section, with the remaining length thereof being ineffective to promote any significant intensification of the convective heat exchange process. An increase in the angle $\phi$ of inclination above 45 deg. will bring about a faster rate of pressure losses in the heat carrier in relation to the growth of the heat transfer coefficient ($\alpha/\alpha<\Delta P/\Delta P'$), as compared to the parameters in the similar passages but of smooth type. This, therefore, fails to provide favourable conditions for highly intensified convective heat exchanging process, which leads to an excessive consumption of energy needed for the heat-carrier delivery to obtain a requisite degree of intensification of the convective heat exchange process. An increase of the angle $\phi$ above 45 deg. will drastically enhance the stabilizing effect of the converging section of the passage on the development of the tubular structure of the heat carrier flow at the exit from the diverging section of the passage. As a result of this, the three-dimensional vortices generated at the diverging section of the passage are damped almost completely. As this happens, the vortices formed in the depressions 5, 7 (FIG. 1) change their three-dimensional structure for two-dimensional. The presence of two-dimensional vortices in the depressions 5, 7 have but insignificant effect on the intensification of the heat exchange process. In addition, a substantial amount of energy is required to keep them active, this being inexpedient.

With the purpose of ensuring uniform distribution of air over the passage in the intertubular space of the tube-and-plate heat exchanger, the wave line outlining the profile of the cooled plates 2, 3 is confined, at the air inlet and outlet places, by the rectilinear section 12 (FIG. 4) lying on the axis 11 of its symmetry.

In this case, the adjacent passages will have the same resistance to thereby result in uniform distribution of air over the passages of the intertubular space. Hence is the enhanced thermodynamic effectiveness of the tube-and-plate heat exchanger.

In the preferred embodiment of the invention the adjacent plates 2 and 3 (FIG. 1) are formed with broached holes 8 the edges 9 of which are oriented in oppositely reflected fashion to the respective projections 4 and 6 and the depressions 5 and 7. It is to be emphasized that this type of orientation of the edges 9 of the broached holes 8 is the sole possible orientation to enable the heat exchanger construction according to the invention wherein the intertubular space is formed with passages having divering-converging sections.

The best possible thermal contact between the cooled plates 2, 3 and the plain tubes 1, is obtained by a sintering method effected in furnaces. The projections 4 and 6 and the depressions 5 and 7 are not provided at those places of the cooled plates 2 and 3 which are formed with the broached holes 8. If the holes 8 are broached in the cooled plates 2 and 3 over the undulatory surface, the generatrix of the surface of the upstanding edges 9 of the holes 8 will not be similar to that of the plain tubes which will fail to ensure their intimate mating (after sintering) with the surface of the plain tube 1 throughout the contour of the edges 9 of the holes 8, and will impair thermal contact between the cooled plates 2 and 3 with the plain tube 1. The use of the tube-and-plate heat exchanger as the water-to-air cooler for tractors has made it possible to carry out reduction in size and weight thereof by 1.5 to 2 times, all other conditions being equal. Taking into account the fact that the coolers intended for use in tractors, automobiles and diesel locomotives are manufactured from expensive and scarce non-ferrous metals, such as brass, commercially pure electrolitic copper and tin solder, as well as considering mass production of these coolers, estimated at millions of pieces per year, the application of the tube-and-plate heat exchanger for the above purposes will give substantial economic effect.

COMMERCIAL APPLICABILITY

This invention can find utility in the manufacture of air-to-air heat exchangers, and liquid-to-air heat exchangers intended for various applications in the constructions of air coolers and evaporators required for condensation and evaporation of various liquids. This type of heat exchanger is well adapted to operate on both contaminated and uncontaminated air.

The heat exchanger construction of the invention is most advantageous for use as water-to-air and oil-to-air coolers incorporated in cooling systems of both movable and stationary power plants.

What is claimed is:

1. A tube-and-plate heat exchanger for said exchanging heat between first and second heat carriers, said heat exchanger comprising:

a plurality of tubes through which the first heat carrier flows, the tubes oriented in a parallel array;

an inlet and an outlet for said second heat carrier; and a plurality of spaced plates mounted on said tubes, each of said tubes extending through each of said plurality of plates, each pair of adjacent plates defining a passageway between said inlet and said outlet to convey said second heat carrier across said tubes, the cross section of each plate being in the form of alternating depressions and projections in the direction of flow defining a continuous symmetrically waved line, adjacent plates being positioned so that the depressions of one plate are opposite the projections of an adjacent plate, the space between each set of plates defining a passageway having continuous, symmetrical, alternately converging and diverging sections, the diverging sections having an angle of divergence ($\psi$) in the direction of flow of said second heat carrier and with respect to the axis of the passageway selected to be greater than the critical angle at which the loss in hydrodynamic stability of the laminar structure of the second heat carrier flow occurs, each of the plates including rectilinear sections between adjacent depressions and projections, the projections and the depressions of the spaced plates being in continuous relationship and the rectilinear sections having the same angle ($\phi$) of inclination to the axis of symmetry of the wave line outlining the cross section of the spaced plate, which angle equals halve the angle ($\psi$) of divergence, wherein the projections and the depressions of the spaced plates have an inner radius (R) of bending between one and twenty times the thickness ($\delta$) of the material of the spaced plate.

* * * * *